US005762116A

United States Patent [19]

Moore

[11] Patent Number: 5,762,116

[45] Date of Patent: Jun. 9, 1998

[54] SYSTEM FOR FILLING BOTTLES WITH PILLS

[76] Inventor: Leslie A. Moore, 3146 Fiesta Dr., Dunedin, Fla. 34698

[21] Appl. No.: 839,142

[22] Filed: Apr. 23, 1997

[51] Int. Cl.[6] ..... B65B 1/04

[52] U.S. Cl. ..... 141/145; 141/152; 141/177; 53/253; 198/473.1; 198/803.11

[58] Field of Search ..... 141/144, 145, 141/152, 165, 168, 170, 177, 262; 53/253, 201; 198/473.1, 803.11

[56] References Cited

U.S. PATENT DOCUMENTS

| | | | |
|---|---|---|---|
| 819,274 | 5/1906 | Haight | 141/177 |
| 3,078,630 | 2/1963 | Mayer, Jr. et al. | 53/201 |
| 4,051,878 | 10/1977 | Ohmeis et al. | 141/152 |

*Primary Examiner*—Henry J. Recla
*Assistant Examiner*—Steven O. Douglas

[57] ABSTRACT

A system for filling bottles with pills including a drive wheel formed with an upper generally circular plate and a vertically spaced lower generally circular plate with concentric peripheries and axially aligned central apertures extending therethrough supportable on a drive shaft for rotation therewith. The plates are formed with a plurality of symmetrically located recesses on the peripheries of the plates for receiving bottles therein. A depth spacer is positioned within each recess and is radially movable toward and away from the axis of rotation and the peripheries of the plates. A pair of width plates are positioned on opposite sides of each recess to vary the width of each recess. The depth spacers and width plates allow the recesses to accommodate various sizes of bottles so that the openings in the bottles will be properly positioned at all times for use in automated pill dispensing systems.

12 Claims, 5 Drawing Sheets

110
112
114

3
3
38
50
52
34
36
32
62
86
42

FIG 3
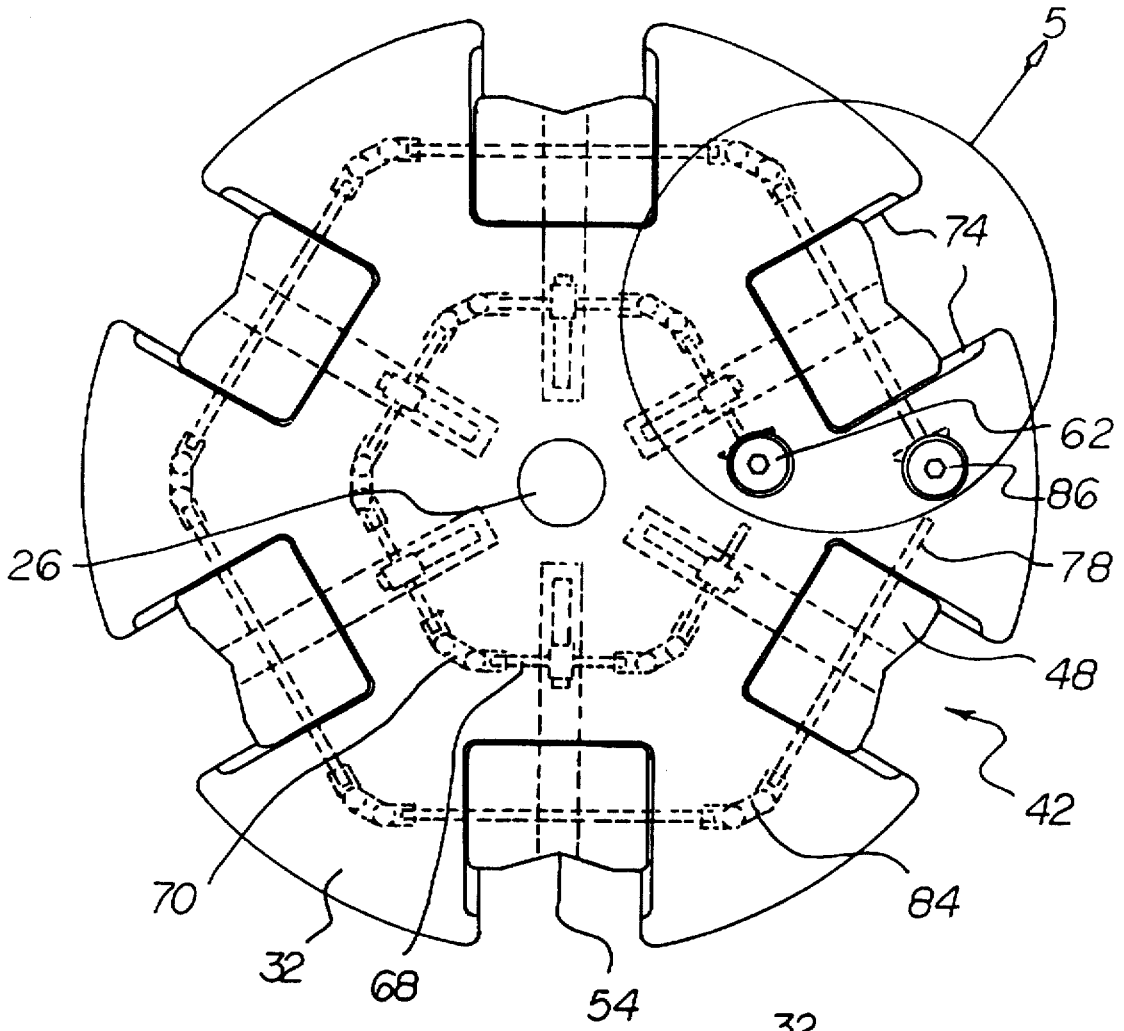
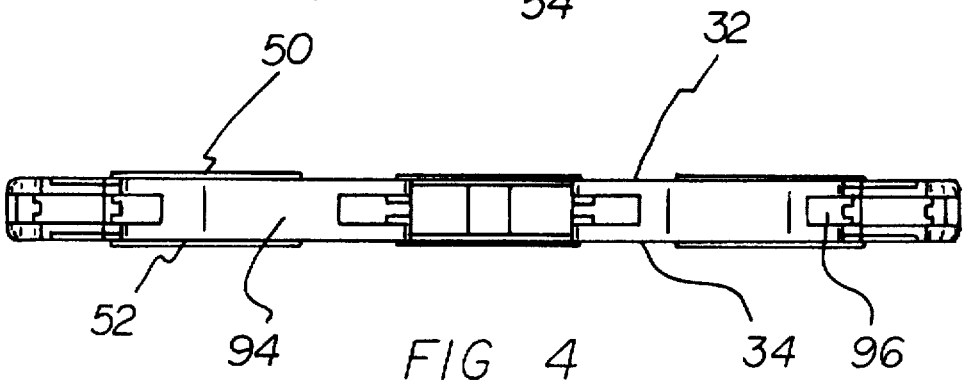
FIG 4

FIG 7
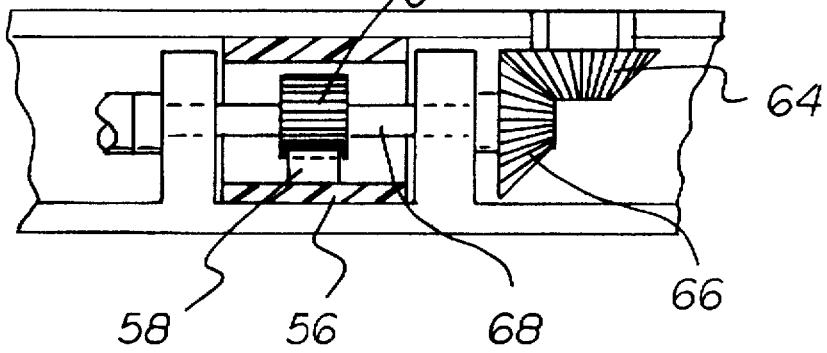
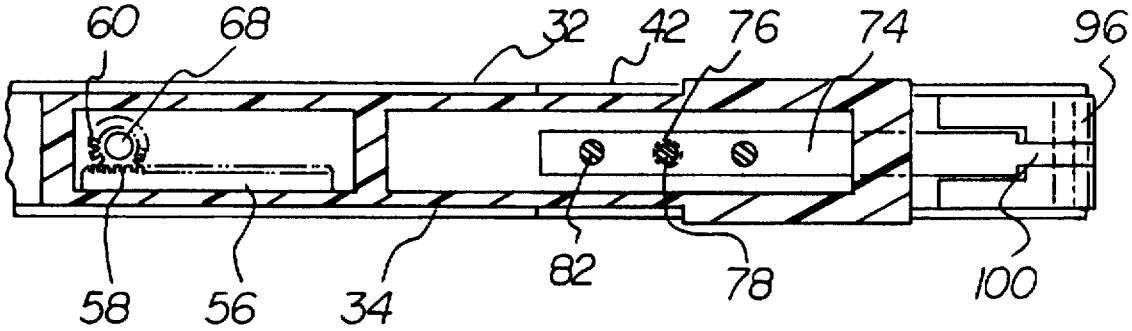
FIG 8

SYSTEM FOR FILLING BOTTLES WITH PILLS

BACKGROUND OF THE INVENTION

1. Field of the Invention

The present invention relates to a system for filling bottles with pills and more particularly pertains to enabling bottles of differing sizes to filled with pills with a system for filling bottles with pills.

2. Description of the Prior Art

The use of fixed bottle holders is known in the prior art. More specifically, fixed bottle holders heretofore devised and utilized for the purpose of holding a singular sized bottle for filling are known to consist basically of familiar, expected and obvious structural configurations, notwithstanding the myriad of designs encompassed by the crowded prior art which have been developed for the fulfillment of countless objectives and requirements.

The system for filling bottles with pills according to the present invention substantially departs from the conventional concepts and designs of the prior art, and in doing so provides an apparatus primarily developed for the purpose of enabling bottles of differing sizes to filled with pills.

Therefore, it can be appreciated that there exists a continuing need for new and improved system for filling bottles with pills which can be used for enabling bottles of differing sizes to filled with pills. In this regard, the present invention substantially fulfills this need.

SUMMARY OF THE INVENTION

In the view of the foregoing disadvantages inherent in the known types of fixed bottle holders now present in the prior art, the present invention provides an improved system for filling bottles with pills. As such, the general purpose of the present invention, which will be described subsequently in greater detail, is to provide a new and improved system for filling bottles with pills and method which has all the advantages of the prior art and none of the disadvantages.

To attain this, the present invention essentially comprises a linear conveyor assembly adapted to feed bottles along a linear path while being filled with pills. The linear path includes an intermediate region where bottles are moved from the linear path in an unfilled condition along an arcuate path and returned to the linear path in a filled condition. The arcuate path includes a planar support plate for receiving bottoms of the bottles being conveyed. The linear path and arcuate path include side rails adapted to preclude the lateral tipping of the bottles moved along the linear path and the arcuate path. A rotary conveyor assembly is positioned in part over the linear conveyor assembly and partially offset therefrom. The rotary conveyor assembly includes a drive shaft in a vertical orientation with an axis of rotation laterally offset from the linear conveyor assembly. A drive wheel is formed with an upper generally circular plate and a vertically spaced lower generally circular plate with concentric peripheries and axially aligned central apertures extending therethrough supported on the drive shaft for rotation therewith and with a motor for effecting the concurrent rotation of the drive shaft and the upper and lower plates. The plates are formed with six symmetrically located recesses on the peripheries of the plates for receiving, supporting and driving bottles therein when moved from the linear path to the arcuate path and back to the linear path. A depth spacer is positioned within each recess. Each depth spacer includes a plate radially movable toward and away from the axis of rotation and the peripheries of the plates. Each depth spacer has a planar rack with gear teeth extending upwardly therefrom and an associated pinion gear rotatable about a horizontal axis to move the depth plate to a pre-selected position within the recess. A single depth dial with a drive bevel gear is rotatable about a vertical axis located between the plates and with a driven bevel gear rotatable about a horizontal axis operatively coupled to the drive bevel gear and a plurality of depth rods having universal joints coupling the depth rods whereby rotation of the depth dial in one direction of rotation will rotate the depth rods in a common direction of rotation. The pinion gears are located on the depth rods at a central extent whereby rotation of the depth dial will rotate the depth rods to rotate the pinion gears and hence the rack gears for selectively moving the depth plates. A pair of width plates are positioned on opposite sides of each recess with interior screw threads located therethrough and a width rod extending through each pair of width plates. Each of the width rods have oppositely angled threads therewith for moving the width plates toward and away from each other to vary the width of each recess. A plurality of universal joints connect the width rods with an associated single width dial having a bevel drive gear rotatable about a vertical axis and an associated bevel driven gear rotatable about a horizontal axis to rotate the width rods concurrently. Fixed spacers couple the plates between the recesses and a pair of pivot plates at each recess adjacent the peripheries. Each pivot plate is rotatably coupled to a width plate and formed with an external surface adapted to fill the space between the plates. Each pivot plate has an interior cam follower surface and an associated fixed cam pin in slidable contact with the interior cam follower surface whereby linear movement of the width plates will linearly move the pivot plates concurrently therewith to allow the interior cam follower surfaces of the pivot plates to be rotated inwardly due to contact by the cam pin. A filler plate having a central aperture is coaxial with and coupled to the drive shaft for rotation therewith. The filler plate has peripheral apertures therethrough axially aligned with the recesses. Each peripheral aperture has an enlarged funnel thereabove whereby pills deposited into each funnel will allow the pills to be dropped into a bottle in an associated recess during movement along the arcuate path.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved system for filling bottles with pills which has all the advantages of the prior art fixed bottle holders and none of the disadvantages.

It is another object of the present invention to provide a new and improved system for filling bottles with pills which may be easily and efficiently manufactured and marketed.

It is a further object of the present invention to provide a new and improved system for filling bottles with pills which is of durable and reliable construction.

An even further object of the present invention is to provide a new and improved system for filling bottles with pills which is susceptible of a low cost of manufacture with regard to both materials and labor, and which accordingly is then susceptible of low prices of sale to the consuming public, thereby making such a system for filling bottles with pills economically available to the buying public.

Even still another object of the present invention is to provide a new and improved system for filling bottles with pills for enabling bottles of differing sizes to filled with pills.

Lastly, it is an object of the present invention to provide a new and improved system for filling containers including a drive wheel formed with an upper generally circular plate and a vertically spaced lower generally circular plate with concentric peripheries and axially aligned central apertures extending therethrough supportable on a drive shaft for rotation therewith. The plates are formed with a plurality of symmetrically located recesses on the peripheries of the plates for receiving containers therein. A depth spacer is positioned within each recess and is radially movable toward and away from the axis of rotation and the peripheries of the plates. A pair of width plates are positioned on opposite sides of each recess to vary the width of each recess.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top plan view of the drive wheel of the present invention as taken along line 3—3 of FIG. 2.

FIG. 4 is a side elevation view of the drive wheel of FIG. 3.

FIG. 7 is a cross-sectional view as taken along line 7—7 of FIG. 5.

FIG. 8 is a cross-sectional view as taken along line 8—8 of FIG. 5.

The same reference numerals refer to the same parts through the various figures.

DESCRIPTION OF THE PREFERRED EMBODIMENT

With reference now to the drawings, and in particular, to FIGS. 1 through 8 thereof, the preferred embodiment of the new and improved system for filling bottles with pills embodying the principles and concepts of the present invention and generally designated by the reference number 10 will be described.

Specifically, it will be noted in the various Figures that the device relates to a system for filling bottles with pills for enabling bottles of differing sizes to filled with pills. In its broadest context, the device consists of a linear conveyor assembly, a rotary conveyor assembly, a drive wheel, depth spacers, pairs of width plates, fixed spacers and a filler plate. Such components are individually configured and correlated with respect to each other so as to attain the desired objective.

Figure 1:
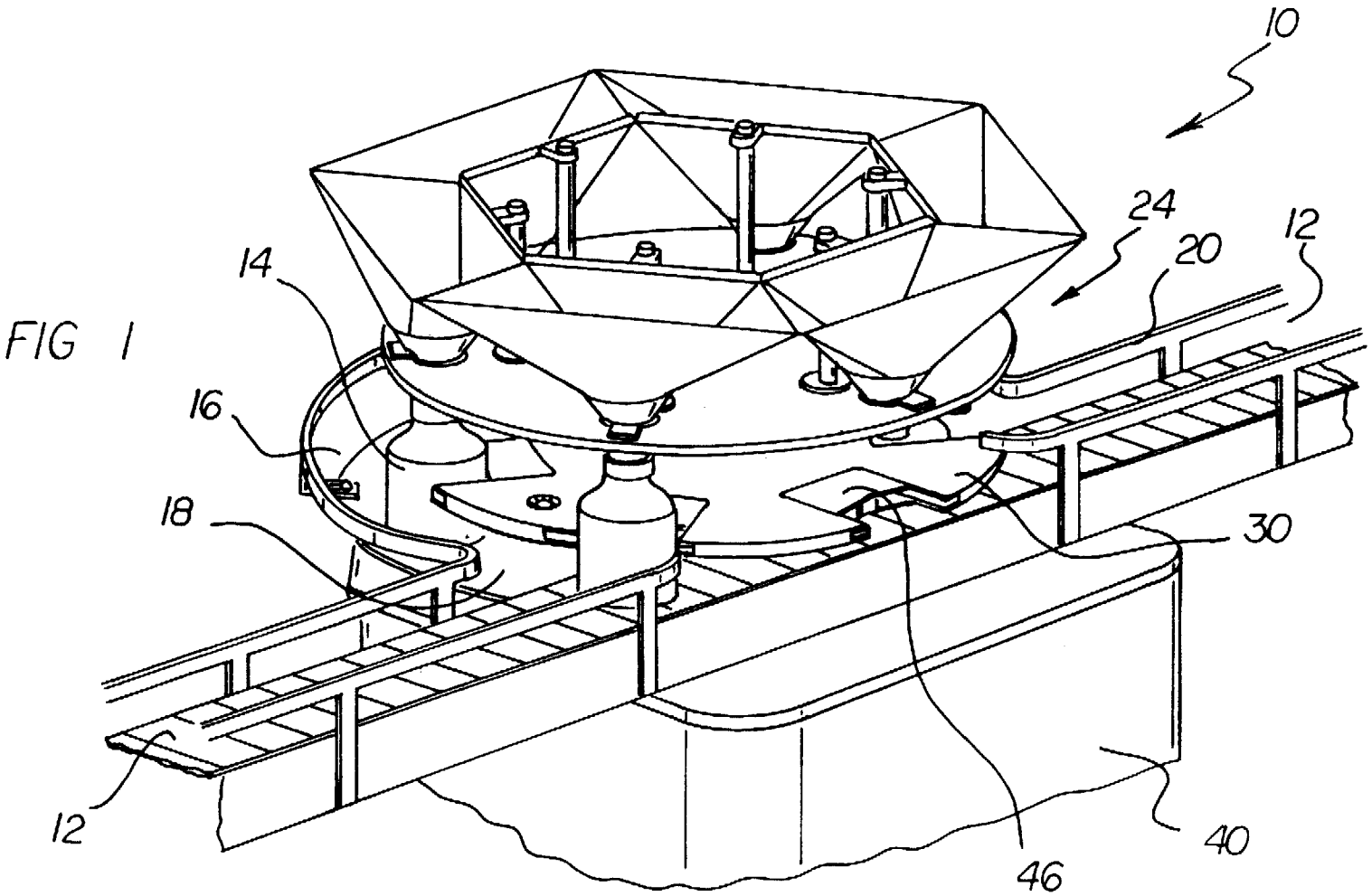
FIG. 1 is a perspective view of the preferred embodiment of the system for filling bottles with pills constructed in accordance with the principles of the present invention.

The linear conveyor assembly, as illustrated in FIG. 1, is adapted to feed bottles along a linear path 12 while being filled with pills. The linear path 12 includes an intermediate region where bottles 14 are moved from the linear path 12 in an unfilled condition along an arcuate path 16 and returned to the linear path 12 in a filled condition. The arcuate path 16 includes a planar support plate 18 for receiving bottoms of the bottles 14 being conveyed. The planar support plate 18 is positioned on the same plane as the linear and arcuate paths. The linear path 12 and arcuate path 16 include side rails 20 adapted to preclude the lateral tipping of the bottles 14 moved along the linear path 12 and the arcuate path 16. Alternately, other containers could be readily used in the system 10 in replace of bottles and items other than pills could also be used.

The rotary conveyor assembly 24, as best illustrated in FIG. 1, is positioned in part over the linear conveyor assembly and partially offset therefrom. The rotary conveyor assembly 24 includes a drive shaft 26 in a vertical orientation with an axis of rotation laterally offset from the linear conveyor assembly.

The drive wheel 30 is formed with an upper generally circular plate 32 and a vertically spaced lower generally circular plate 34 with concentric peripheries 36 and axially aligned central apertures 38, extending therethrough supported on the drive shaft 26 for rotation therewith and with a motor (not illustrated) for effecting the concurrent rotation of the drive shaft 26 and the upper 32 and lower plates 34. The motor is disposed within a housing 40 situated below the drive wheel 30. The housing 40 is illustrated in FIG. 1. The plates 32,34 are formed with six symmetrically located recesses 42 on the peripheries of the plates for receiving, supporting and driving bottles 14 therein when moved from the linear path 12 to the arcuate path 16 and back to the linear path 12. Any number of recesses 42 can be provided so long as their is adequate space therebetween.

A depth spacer 46 is positioned within each recess 42. Each depth spacer 46 includes a plate 48 radially movable toward and away from the axis of rotation and the peripheries 36 of the plates 32,34. In the preferred embodiment, two plates 48 are provided. An upper plate 50 is positioned with respect to the upper circular plate 32 disposed over the recess 42 and a lower plate 52 is positioned with respect to the lower circular plate 34 disposed below the recess 42. Note FIG. 2. The upper 50 and lower plate 52 are each provided with an inwardly angled leading edge 54. Each depth spacer 46 has a planar rack 56 with gear teeth 58 extending upwardly therefrom and an associated pinion gear 60 rotatable about a horizontal axis to move the plate 48 to a pre-selected position within the recess 42. Note FIGS. 5 and 7–8. A single depth dial 62 with a drive bevel gear 64 is rotatable about a vertical axis located between the plates 32,34 and with a driven bevel gear 66 rotatable about a horizontal axis operatively coupled to the drive bevel gear 64 and positioned thereabove and a plurality of depth rods 68 having universal joints 70 coupling the depth rods 68 whereby rotation of the depth dial 62 in one direction of rotation will rotate the depth rods 68 in a common direction of rotation. The pinion gears 60 are located on the depth rods 68 at a central extent whereby rotation of the depth dial 62 will rotate the depth rods 68 to rotate the pinion gears 60 and hence the rack gears for selectively moving the plates 48. Alternately, instead of the depth dial 62, the drive bevel gear 64 is positioned below and coupled to the driven bevel gear 66 with the drive bevel gear 64 provided with an opening in a central point thereof to allow the insertion of a tool to facilitate rotation of the drive bevel gear 64. For example, the opening can be hexagonal in shape for coupling with an Allen wrench. Access to the drive bevel gear 64 can be gained through an opening in the lower plate 34 either with or without a movable access door or the like.

A pair of width plates 74 are positioned on opposite sides of each recess 42 with interior screw threads 76 located therethrough and a width rod 78 extending through each pair of width plates 74. The width rods 78 have oppositely angled threads 80 therewith for moving the width plates 74 toward and away from each other to vary the width of each recess 42. Note FIGS. 5, 6 and 8. A pair of guide rods 82 are positioned on opposing sides of the width rod 78 to facilitate the moving of the width plates 74. A plurality of universal joints 84 connect the width rods 78 with an associated single width dial 86 having a bevel drive gear 88 rotatable about a vertical axis and an associated bevel driven gear 90 rotatable about a horizontal axis to rotate the width rods 78 concurrently.

The fixed spacers 94 couple the plates 32,34 between the recesses 42 and a pair of pivot plates 96 at each recess 42 adjacent the peripheries. Each pivot plate 96 is rotatably coupled to a width plate 74 and formed with an external surface 98 adapted to fill the space between the plates. A forward end 100 of the width plates 74 are of a reduced thickness whereby a pivot pin 102 extends through the pivot plate 96 for pivotal coupling with respect to the width plates 74. Each pivot plate 96 has an interior cam follower surface 104 and an associated fixed cam pin 106 in slidable contact with the interior cam follower surface 104 whereby linear movement of the width plates 74 will linearly move the pivot plates 96 concurrently therewith to allow the interior cam follower surfaces 104 of the pivot plates 96 to be rotated inwardly due to contact by the cam pin 106. This will allow the interior end of the pivot plates 96 to contact the bottle 14 similar to a pair of fingers being pinched together. Note FIGS. 5 and 6.

Figure 2:
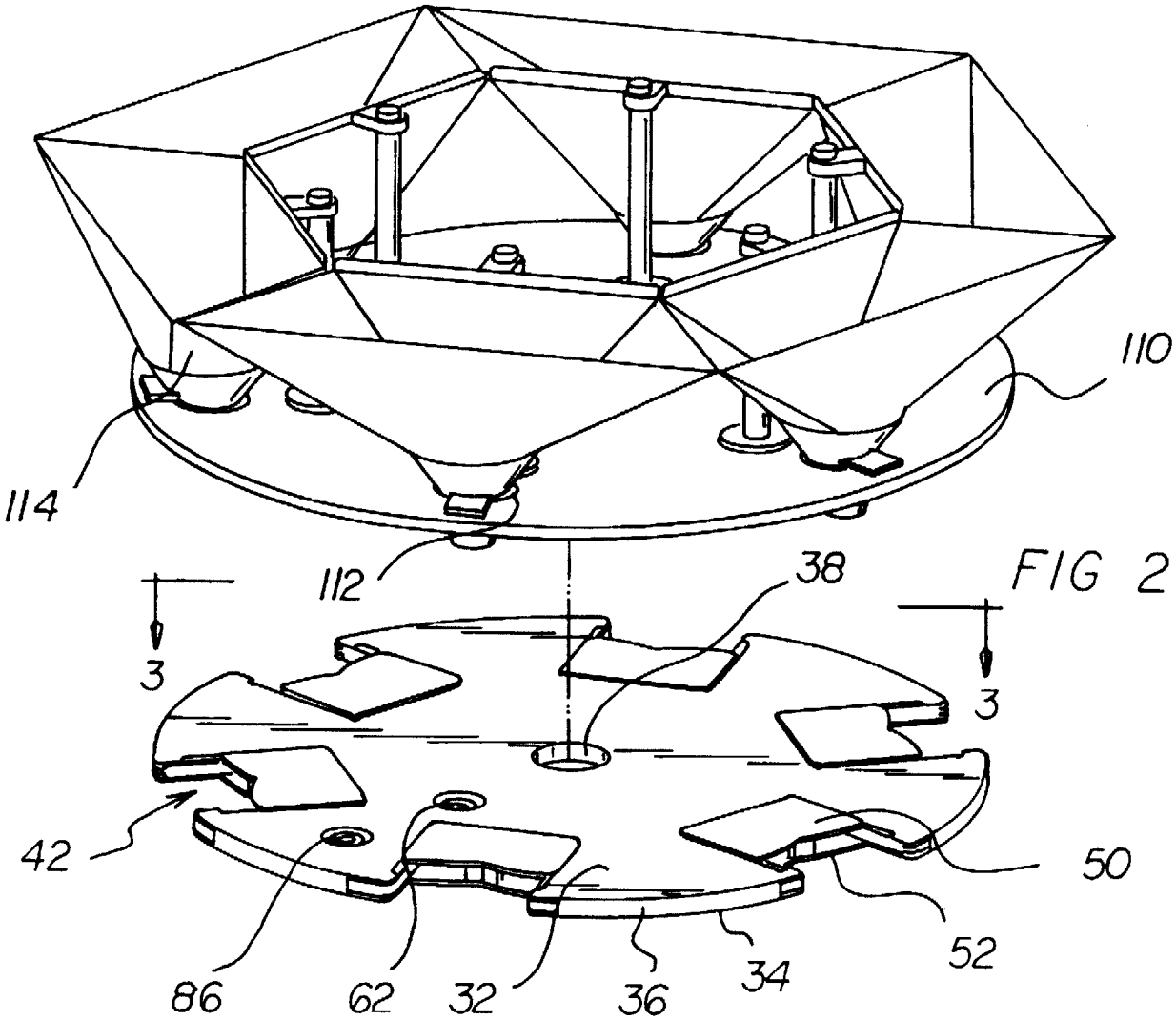
FIG. 2 is a plan perspective view of the present invention illustrating the drive wheel separated from the filler plate.
Figure 5:
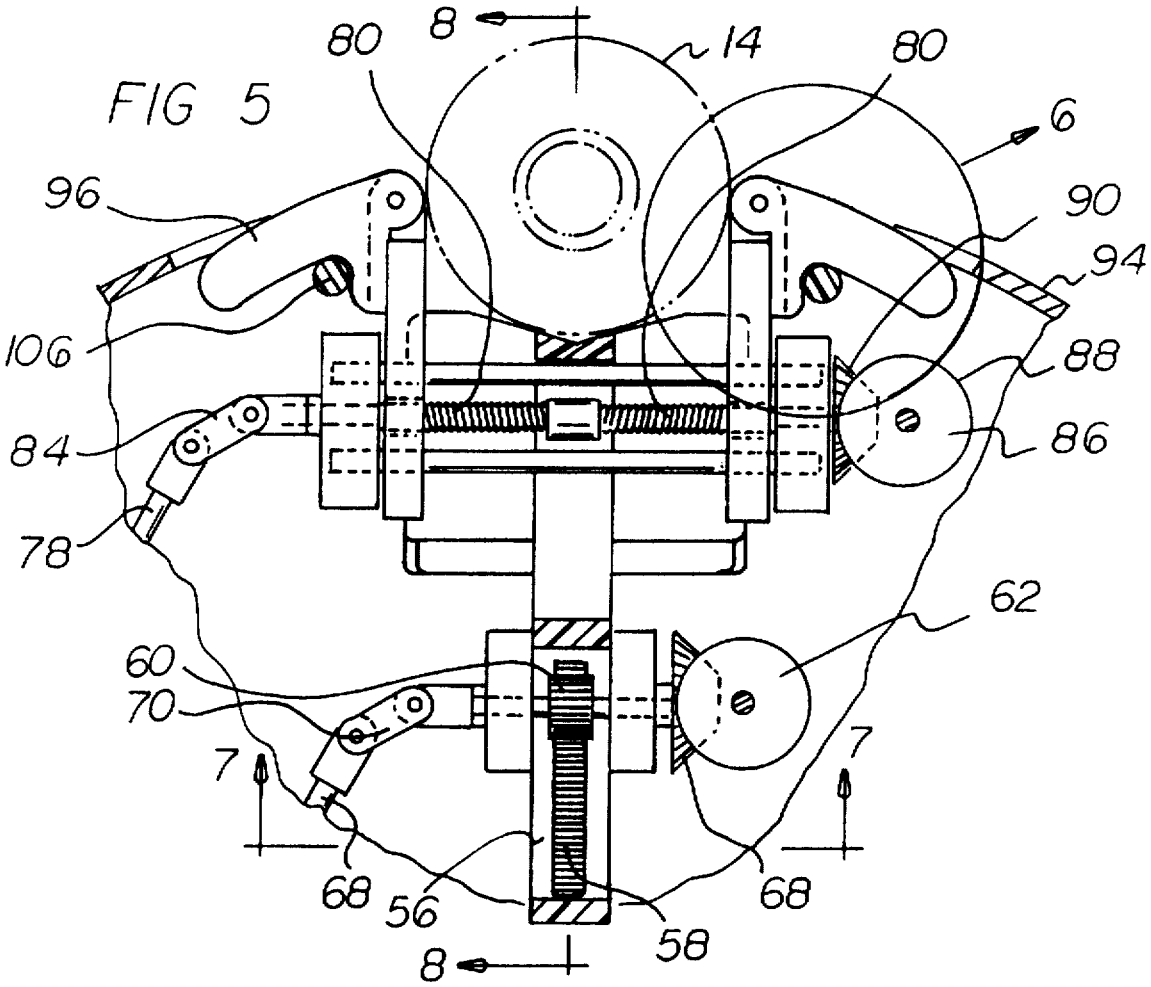
FIG. 5 is an enlarged sectional view of the drive wheel as taken from circle 5 of FIG. 3.
Figure 6:
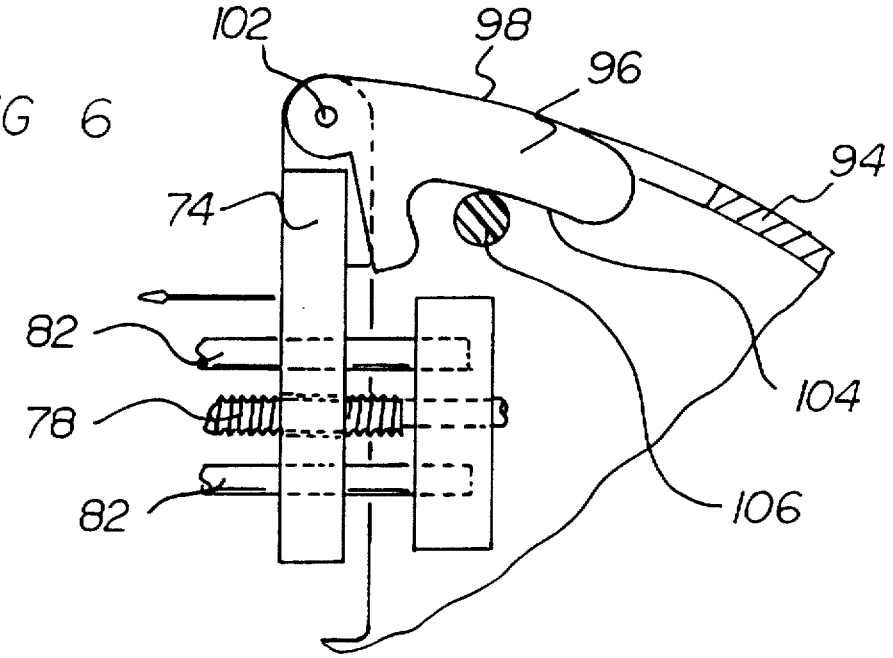
FIG. 6 is an enlarged sectional view of the pivot plate and the side plate as taken from circle 6 of FIG. 5.

The filler plate 110, as illustrated in FIGS. 1 and 2, has a central aperture that is coaxial with and coupled to the drive shaft 26 for rotation therewith. The filler plate 110 has peripheral apertures 112 therethrough axially aligned with the recesses 42. Each peripheral aperture 112 has an enlarged funnel 114 thereabove whereby pills deposited into each funnel 114 will allow the pills to be dropped into a bottle 14 in an associated recess 42 during movement along the arcuate path 16.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by letters patent of the united states is as follows:

1. A system for filling bottles with pills for enabling bottles of differing sizes to be filled with pills comprising, in combination:

a linear conveyor assembly adapted to feed bottles along a linear path while being filled with pills, the linear path including an intermediate region where bottles are moved from the linear path in an unfilled condition along an arcuate path and returned to the linear path in a filled condition, the arcuate path including a planar support plate for receiving bottoms of the bottles being conveyed, the linear path and arcuate path including side rails adapted to preclude the lateral tipping of the bottles moved along the linear path and the arcuate path;

a rotary conveyor assembly positioned in part over the linear conveyor assembly and partially offset therefrom, the rotary conveyor assembly including a drive shaft in a vertical orientation with an axis of rotation laterally offset from the linear conveyor assembly;

a drive wheel formed with an upper generally circular plate and a vertically spaced lower generally circular plate with concentric peripheries and axially aligned central apertures extending therethrough supported on the drive shaft for rotation therewith and with a motor for effecting the concurrent rotation of the drive shaft and the upper and lower plates, the plates being formed with six symmetrically located recesses on the peripheries of the plates for receiving, supporting and driving bottles therein when moved from the linear path to the arcuate path and back to the linear path;

a depth spacer positioned within each recess, each depth spacer including a plate radially movable toward and away from the axis of rotation and the peripheries of the plates, each depth spacer having a planar rack with gear teeth extending upwardly therefrom and an associated pinion gear rotatable about a horizontal axis to move the plate to a pre-selected position within the recess, a single depth dial with a drive bevel gear rotatable about a vertical axis located between the plates and with a driven bevel gear rotatable about a horizontal axis operatively coupled to the drive bevel gear and a plurality of depth rods having universal joints coupling the depth rods whereby rotation of the depth dial in one direction of rotation will rotate the depth rods in a common direction of rotation, the pinion gears being located on the depth rods at a central extent whereby rotation of the depth dial will rotate the depth rods to rotate the pinion gears and hence the rack gears for selectively moving the depth plates;

a pair of width plates on opposite sides of each recess with interior screw threads located therethrough and a width rod extending through each pair of width plates, each of the width rods having oppositely angled threads therewith for moving the width plates toward and away from each other to vary the width of each recess, a plurality of universal joints connecting the width rods with an associated single width dial having a bevel drive gear rotatable about a vertical axis and an associated bevel driven gear rotatable about a horizontal axis to rotate the width rods concurrently;

fixed spacers coupling the plates between the recesses and a pair of pivot plates at each recess adjacent the peripheries, each pivot plate being rotatably coupled to a width plate and formed with an external surface adapted to fill the space between the plates, each pivot plate having an interior cam follower surface and an associated fixed cam pin in slidable contact with the interior cam follower surface whereby linear movement of the width plates will linearly move the pivot plates concurrently therewith to allow the interior cam follower surfaces of the pivot plates to be rotated inwardly due to contact by the cam pin; and a filler plate having a central aperture coaxial with and coupled to the drive shaft for rotation therewith, the filler plate having peripheral apertures therethrough axially aligned with the recesses, each peripheral aperture having an enlarged funnel thereabove whereby pills deposited into each funnel will allow the pills to be dropped into a bottle in an associated recess during movement along the arcuate path.

2. A system for moving containers of differing sizes comprising, in combination:

a drive wheel formed with an upper generally circular plate and a vertically spaced lower generally circular plate with concentric peripheries and axially aligned central apertures extending therethrough supportable on a drive shaft for rotation therewith, the plates being formed with a plurality of symmetrically located recesses on the peripheries of the plates;

a depth spacer positioned within each recess radially movable toward and away from the axis of rotation and the peripheries of the plates; and a pair of width plates on opposite sides of each recess to vary the width of each recess.

3. The system as set forth in claim 2 and further including a linear conveyor assembly adapted to feed containers along a linear path, the linear path including an intermediate region where bottles are moved from the linear path in an unfilled condition along an arcuate path and returned to the linear path in a filled condition, the arcuate path including a planar support plate for receiving bottoms of the bottles being conveyed, the linear path and arcuate path including side rails adapted to preclude the lateral tipping of the bottles moved along the linear path and the arcuate path.

4. The system as set forth in claim 3 and further including a rotary conveyor assembly positioned in part over the linear conveyor assembly and partially offset therefrom, the rotary conveyor assembly including a drive shaft in a vertical orientation with an axis of rotation laterally offset from the linear conveyor assembly.

5. The system as set forth in claim 4 and further including a filler plate having a central aperture coaxial with and coupled to the drive shaft for rotation therewith, the filler plate having peripheral apertures therethrough axially aligned with the recesses, each peripheral aperture having an enlarged funnel thereabove whereby items deposited into each funnel will allow the items to be dropped into a container in an associated recess during movement along the arcuate path.

6. The system as set forth in claim 2 and further including fixed spacers coupling the plates between the recesses and a pair of pivot plates at each recess adjacent the peripheries, each pivot plate being rotatably coupled to a width plate and formed with an external surface adapted to fill the space between the plates, each pivot plate having an interior cam follower surface and an associated fixed cam pin in slidable contact with the interior cam follower surface whereby linear movement of the width plates will linearly move the pivot plates concurrently therewith to allow the interior cam follower surfaces of the pivot plates to be rotated inwardly due to contact by the cam pin.

7. The system as set forth in claim 2 wherein the each depth spacer includes a plate radially movable toward and away from the axis of rotation and the peripheries of the plates, each depth spacer having a planar rack with gear teeth extending upwardly therefrom and an associated pinion gear rotatable about a horizontal axis to move the plate to a pre-selected position within the recess.

8. The system as set forth in claim 7 wherein a single depth dial with a drive bevel gear is rotatable about a vertical axis located between the plates and with a driven bevel gear rotatable about a horizontal axis operatively coupled to the drive bevel gear and a plurality of depth rods having universal joints coupling the depth rods whereby rotation of the depth dial in one direction of rotation will rotate the depth rods in a common direction of rotation.

9. The system as set forth in claim 8 wherein the pinion gears are located on the depth rods at a central extent whereby rotation of the depth dial will rotate the depth rods to rotate the pinion gears and hence the rack gears for selectively moving the depth plates.

10. The system as set forth in claim 2 wherein the pair of width plates are on opposite sides of each recess with interior screw threads located therethrough and a width rod extending through each pair of width plates, each of the width rods having oppositely angled threads therewith for moving the width plates toward and away from each other to vary the width of each recess.

11. The system as set forth in claim 10 wherein a plurality of universal joints connect the width rods with an associated single width dial having a bevel drive gear rotatable about a vertical axis and an associated bevel driven gear rotatable about a horizontal axis to rotate the width rods concurrently.

12. A system for filling bottles with pills for enabling bottles of differing sizes to be filled with pills comprising, in combination:

a rotary conveyor assembly positioned in part over a linear conveyor assembly and partially offset therefrom, the rotary conveyor assembly including a drive shaft in a vertical orientation with an axis of rotation laterally offset from the linear conveyor assembly;

a drive wheel formed with an upper generally circular plate and a vertically spaced lower generally circular plate with concentric peripheries and axially aligned central apertures extending therethrough supported on the drive shaft for rotation therewith and with a motor for effecting the concurrent rotation of the drive shaft and the upper and lower plates, the plates being formed with a plurality of symmetrically located recesses on the peripheries of the plates for receiving, supporting and driving bottles therein when moved along the linear conveyor assembly;

a depth spacer positioned within each recess, each depth spacer including a plate radially movable toward and away from the axis of rotation and the peripheries of the plates, each depth spacer having a planar rack with gear teeth extending upwardly therefrom and an associated pinion gear rotatable about a horizontal axis to move the depth plate to a pre-selected position within the recess, a single depth dial with a drive bevel gear rotatable about a vertical axis located between the plates and with a driven bevel gear rotatable about a horizontal axis operatively coupled to the drive bevel gear and a plurality of depth rods having universal joints coupling the depth rods whereby rotation of the depth dial in one direction of rotation will rotate the depth rods in a common direction of rotation, the pinion gears being located on the depth rods at a central extent whereby rotation of the depth dial will rotate the depth rods to rotate the pinion gears and hence the rack gears for selectively moving the depth plates;

a pair of width plates on opposite sides of each recess with interior screw threads located therethrough and a width rod extending through each pair of width plates, each of the width rods having oppositely angled threads therewith for moving the width plates toward and away from each other to vary the width of each recess, a plurality of universal joints connecting the width rods with an associated single width dial having a bevel drive gear rotatable about a vertical axis and an associated bevel driven gear rotatable about a horizontal axis to rotate the width rods concurrently; and fixed spacers coupling the plates between the recesses and a pair of pivot plates at each recess adjacent the peripheries, each pivot plate being rotatably coupled to a width plate and formed with an external surface adapted to fill the space between the plates, each pivot plate having an interior cam follower surface and an associated fixed cam pin in slidable contact with the interior cam follower surface whereby linear movement of the width plates will linearly move the pivot plates concurrently therewith to allow the interior cam follower surfaces of the pivot plates to be rotated inwardly due to contact by the cam pin.

* * * * *